US008127724B2

(12) United States Patent
Yuasa et al.

(10) Patent No.: US 8,127,724 B2
(45) Date of Patent: Mar. 6, 2012

(54) CYLINDER BLOCK FOR A TWO-CYCLE COMBUSTION ENGINE

(75) Inventors: Tsuneyoshi Yuasa, Kobe (JP); Masanori Kobayashi, Tokorozawa (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 905 days.

(21) Appl. No.: 12/215,286

(22) Filed: Jun. 26, 2008

(65) Prior Publication Data

US 2009/0013981 A1 Jan. 15, 2009

(30) Foreign Application Priority Data

Jun. 29, 2007 (JP) ..... 2007-171839

(51) Int. Cl.
*F02B 25/00* (2006.01)

(52) U.S. Cl. ..... 123/65 R; 123/73 PP; 29/888.06

(58) Field of Classification Search ..... 123/65 R, 123/73 PP; 29/888.06, 888.061
See application file for complete search history.

(56) References Cited

U.S. PATENT DOCUMENTS

| | | | | |
|---|---|---|---|---|
| 4,178,886 | A * | 12/1979 | Uchinishi | 123/73 A |
| 6,367,432 | B1 * | 4/2002 | Araki | 123/73 R |
| 6,408,805 | B2 * | 6/2002 | Uenoyama et al. | 123/73 PP |
| 6,450,135 | B1 * | 9/2002 | Araki | 123/73 B |
| 6,644,251 | B2 * | 11/2003 | Klaric | 123/73 A |
| 6,899,158 | B2 * | 5/2005 | Matuura et al. | 164/113 |
| 6,928,729 | B2 * | 8/2005 | Britt et al. | 29/888.06 |
| 7,165,597 | B2 * | 1/2007 | Yamada et al. | 164/98 |
| 7,293,536 | B2 * | 11/2007 | Yuasa | 123/73 PP |
| 7,331,315 | B2 * | 2/2008 | Mavinahally | 123/73 PP |
| 7,395,801 | B2 * | 7/2008 | Yuasa et al. | 123/195 R |
| 7,516,725 | B2 * | 4/2009 | Uenoyama et al. | 123/73 PP |
| 2001/0032602 | A1 | 10/2001 | Bergmann et al. | |
| 2002/0000038 | A1 * | 1/2002 | Matuura et al. | 29/888.06 |
| 2004/0025817 | A1 * | 2/2004 | Uenoyama et al. | 123/73 A |
| 2004/0079304 | A1 * | 4/2004 | Notaras et al. | 123/73 F |
| 2007/0119404 | A1 | 5/2007 | Yuasa et al. | |

FOREIGN PATENT DOCUMENTS

| | | |
|---|---|---|
| JP | 54-067115 | 5/1979 |
| JP | 58-195040 | 12/1983 |
| JP | 61-060805 | 3/1986 |
| JP | 2000-145536 | 5/2000 |
| JP | 2002-004866 | 1/2002 |
| JP | 2007-146770 | 6/2007 |

OTHER PUBLICATIONS

Japanese Application No. 2007-171839 Notification of Reasons for Rejection dated Feb. 15, 2011, 2 pages.

* cited by examiner

*Primary Examiner* — Noah Kamen
*Assistant Examiner* — Grant Moubry

(57) ABSTRACT

A cylinder block includes a scavenging passage, which extends between a combustion chamber and a crankcase chamber to communicate them together and has a scavenging port defined in the cylinder block so as to open at an inner peripheral surface of the cylinder block. An intake passage or exhaust passage, the scavenging passage including the scavenging port and a throughhole defined therebetween are formed by the use of a molding piece movable in a direction towards the fuel intake passage or exhaust passage and the throughhole is closed by a lid.

9 Claims, 13 Drawing Sheets

CYLINDER BLOCK FOR A TWO-CYCLE COMBUSTION ENGINE

CROSS-REFERENCE TO RELATED APPLICATIONS

This application is based on and claims priority to the Japanese Patent Application No. 2007-171839, filed in Japan on Jun. 29, 2007, which is incorporated by reference in its entirety into this application.

BACKGROUND OF THE INVENTION

1. Field of the Invention

The present invention relates to a two-cycle combustion engine of an air scavenging type which may be used as a drive source for a portable work machine such as a brush cutter, and, more particularly to a cylinder block for such engine and a method for manufacturing such engine cylinder block.

2. Description of the Prior Art

It is well known that some of the two-cycle combustion engines currently available in the market employ an engine cylinder block of a type, in which a scavenging passage defining wall is provided in a region confronting the cylinder bore so as to define a part of the scavenging passage communicating between a combustion chamber and a crankcase chamber. When this type of cylinder block is formed with the use of a molding die, a scavenging port defined above the scavenging passage defining wall is in the form as undercut. Accordingly, the Japanese Laid-open Patent Publication No. 2000-145536 discloses the use of, for example, a disposable core for defining the scavenging port when the cylinder block of the above discussed type is to be formed. On the other hand, the Japanese Patent Publication No. 58-31461 discloses the use of a slider core capable of being slid in a direction radially of the cylinder block in an inner mold for defining the cylinder bore in the cylinder block.

However, where the disposable core is used, it is necessary for the core to be set in the mold assembly each time the cylinder block is formed and, therefore, the workability is low. Furthermore, to manufacture a number of cylinder blocks, a corresponding number of disposable core are required, resulting in increase of the manufacturing cost. Inconveniences are also experienced in association with disposal of the disposable cores, which may cause a problem of industrial waste treatment. On the other hand, the use of the slidable core requires the use of a complicated mold assembly and, also, since the slidable core tends to be worn quickly, a frequent replacement of the slidable core is required, resulting in reduction of the workability and the productivity along with an increase of the manufacturing cost.

SUMMARY OF THE INVENTION

In view of the foregoing, the present invention is intended to provide a cylinder block for a two-cycle combustion engine of an air scavenging type, which can be manufactured at a low cost with high workability and productivity.

In order to accomplish the foregoing object of the present invention, there is provided in accordance with the present invention, a cylinder block for a two-cycle combustion engine, which includes a scavenging passage extending between a combustion chamber and a crankcase chamber to communicate them together and having a scavenging port defined in a cylinder bore so as to open at an inner peripheral surface of the cylinder block. The cylinder block also includes a throughhole defined in a side wall of the scavenging passage on one side adjacent an intake passage or an exhaust passage and communicating an upper portion of the scavenging passage, including the scavenging port, with the intake passage or the exhaust passage, and a lid for closing the throughhole.

According to the present invention, because of the use of the molding piece of a simplified structure that has no complicated slidable core and is used to form the upper portion of the scavenging passage and the intake passage or the exhaust passage through the throughhole, the upper portion of the scavenging passage can easily be formed. The throughhole referred to above can easily be closed by the lid. Accordingly, the workability and the productivity of the cylinder block can be increased and the manufacturing cost can be suppressed to a low value. In addition, since no disposable core is used, no inconvenience will be experienced in disposal of a number of cores.

In a preferred embodiment of the present invention, the lid may be provided with a guide projection positioned in the upper portion of the scavenging passage for guiding a scavenging gas. According to this construction, since the scavenging gas can be guided by the guide projection, an undesirable reduction in scavenging efficiency can be suppressed advantageously.

In another preferred embodiment of the present invention, the scavenging passage may be provided in a pair on respective sides with respect to a longitudinal axis of the intake passage or the exhaust passage. Each of the scavenging passages includes a mixture scavenging passage for supply of an air/fuel mixture and an air scavenging passage for supply of an air, the mixture and air scavenging passages being arranged in a circumferential direction of the cylinder bore. The air scavenging passage is positioned closer to the exhaust passage than the mixture scavenging passage is, and is communicated with the mixture scavenging passage through the throughhole.

According to the foregoing feature, since the air scavenging passage is positioned at a location closer to the exhaust passage than the mixture scavenging passage is, the air/fuel mixture introduced into the combustion chamber through the mixture scavenging passage during the scavenging stroke of the combustion engine can be blocked by the air introduced into the combustion chamber through the air scavenging passage and, therefore, an undesirable blow-by of the air/fuel mixture leaking into the exhaust passage can be effectively suppressed. Even if the air/fuel mixture within the scavenging passage leaks through the throughhole into the air supply passage, the air/fuel mixture can be recovered into the combustion chamber through the air scavenging passage and will not be discharged directly to the outside of the combustion engine.

In a further preferred embodiment of the present invention, an upper portion of each of the scavenging passages may have a vertical dimension, which is smaller than that of the air supply passage, and a stepped face of a step between that upper portion of the scavenging passage and an air supply passage is formed in a peripheral edge of the throughhole so as to be exposed to the air supply passage; and wherein the lid is held in engagement with the stepped face.

According to the foregoing feature, the lid can be stably supported by causing the lid to engage with the stepped face. In addition, since the stepped face serves as a sealing face, the sealability can be increased when the throughhole is closed by the lid.

The present invention also provides a method of forming the cylinder block of the above described construction for the two-cycle combustion engine by means of a casting. This molding method includes forming the intake passage or the exhaust passage, an upper portion of the scavenging passage including the scavenging port, the throughhole defined therebetween, by using a molding piece movable in a direction conforming to a longitudinal axis of the intake passage or the exhaust passage, and closing the throughhole with the lid.

The upper portion referred to above means a portion adjacent the top of the cylinder block in a direction along the longitudinal axis of the cylinder block. The upper portion of the scavenging passage including the scavenging port, as recited above, is intended to mean only the scavenging port on one occasion, and to mean both of the scavenging port and a portion extending therefrom in a direction radially outwardly of the cylinder block on another occasion.

According to the present invention, the upper portion of the scavenging passage can easily be formed by means of the molding piece of a simplified structure having no complicated slidable insert. In other words, when the molding piece is opened by removing from a radial direction of the cylinder block, that is, from one side of the fuel intake passage or the exhaust passage, the fuel intake passage or the exhaust passage and the upper portion of the scavenging passage can be formed. The throughhole left by opening of the molding piece can easily be closed by the use of the lid. Also, since the molding piece can be repeatedly utilized for the manufacture of cylinder blocks and the exchange frequency thereof is low, the method of the present invention has an excellent workability and productivity and, therefore, the manufacturing cost can be suppressed to a low value. Yet, since no disposable core is used, no inconvenience will be experienced in disposal of a number of cores.

In the practice of the cylinder block making method of the present invention, a guide projection for guiding the scavenging gas may be provided in the lid so as to occupy a position in the upper portion of the scavenging passage. Due to the presence of the guide projection, the scavenging gas jetted into the combustion chamber can flow smoothly, and as a result, the scavenging efficiency can therefore be increased. Also, since the guide projection is provided integrally with the lid, but not a member separate therefrom, the number of component parts used will not increase.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Preferred embodiments of the present invention will now be described with reference to the accompanying drawings.

Figure 1:
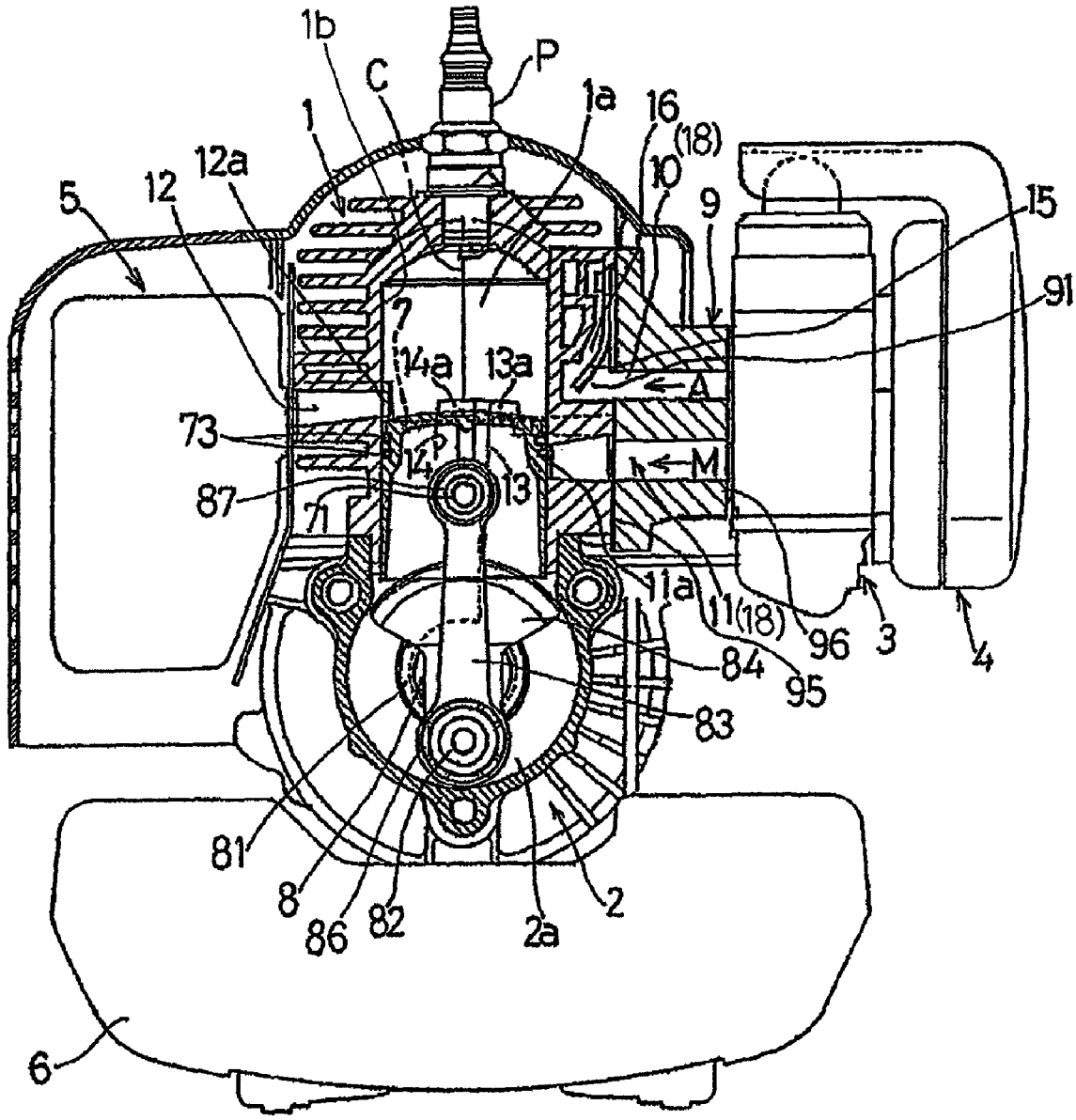
FIG. 1 is a longitudinal sectional view of a two-cycle combustion engine according to a first preferred embodiment of the present invention.

Referring first to FIG. 1 showing the first preferred embodiment of the present invention, there is shown a two-cycle combustion engine, particularly a two-cycle internal combustion engine including a cylinder block 1 and a crankcase 2 having an upper portion on which the cylinder block 1 is secured. The cylinder block 1 has a cylinder bore 1*b* and a combustion chamber 1*a* defined therein. The cylinder block 1 and the crankcase 2 are made of a metallic material such as an aluminum alloy and are so formed by the use of any known molding technique, for example, a die casting technique as is well known to those skilled in the art. The illustrated two-cycle combustion engine has a fuel intake system including a carburetor 3 and an air cleaner 4, both fluidly connected in series with each other with the carburetor 3 mounted on a side portion, for example, a right portion as viewed in FIG. 1, of the cylinder block 1 and also has an exhaust system including a muffler 5 provided on another side portion, for example, a left portion as viewed in FIG. 1, of the cylinder block 1. A fuel tank 6 accommodating a quantity of fuel is fitted to a bottom region of the crankcase 2.

The two-cycle combustion engine also includes a reciprocating piston 7 slidably accommodated within the cylinder bore 1*b* for movement in a direction, for example, in a vertical direction as viewed in FIG. 1, that is parallel to the longitudinal axis C of the cylinder bore 1*b* and defining the combustion chamber 1*a* between the top of the cylinder bore 1*b* and a top portion of the piston 7, in which chamber 1*a* the combustion of the air/fuel mixture takes place.

The crankcase 2 accommodates therein a crankshaft 8 supported by crankshaft bearings 81 for rotation about its own longitudinal axis in a direction at right angles to the direction of movement of the piston 7. This crankshaft 8 has a pair of crank webs 84 connected together by means of a hollow crankpin 82 at a position offset from the longitudinal axis of the crankshaft 8. The reciprocating piston 7 referred to above is drivingly connected with the crankshaft 8 through a connecting rod 83. The connecting rod 83 has a reduced diameter end with a piston journal 87 and a large diameter end with a crankpin journal 86, and connects a hollow piston pin 71 provided in the piston 7 with the crankpin 82 via the piston journal 87 and the crankpin journal 86.

An ignition plug P is replaceably mounted on a top portion of the cylinder block 1.

An insulator 9 is disposed between the cylinder block 1 and the carburetor 3 for minimizing conduction of a high temperature heat from the engine cylinder 1 to the carburetor 3. This insulator 9 has an air supply passage 10 defined in an upper portion thereof and also has an air/fuel mixture supply passage 11 defined in a lower portion thereof so as to extend generally parallel to the air supply passage 10. The air supply passage 10 and the air/fuel mixture supply passage 11 form respective parts of an intake passage 18.

The carburetor 3 referred to previously includes a rotary valve (not shown) operable to adjust the cross section of both of the air supply passage 10 and the mixture supply passage 11. The cylinder block 1 is also formed with an exhaust passage 12 open at an exhaust opening 12*a* in an inner peripheral surface of the cylinder block 1 in communication with the cylinder bore 1*b*. Exhaust gases as a product of combustion of an air/fuel mixture can be exhausted to the outside through the muffler 5 by way of the exhaust passage 12.

Figure 2:
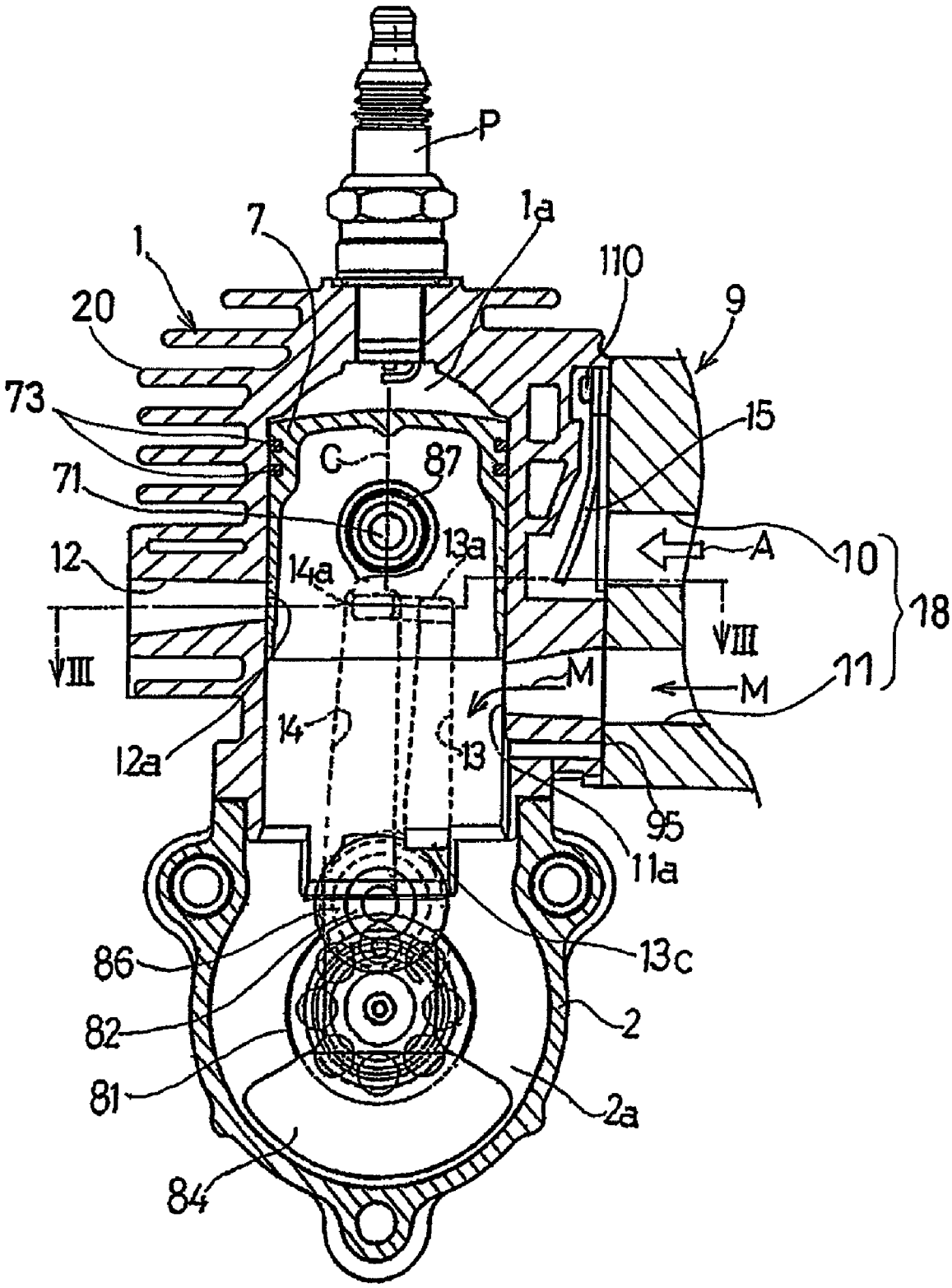
FIG. 2 is a longitudinal sectional view of the two-cycle combustion engine, showing a cylinder block and a crankcase on an enlarged scale.

As best shown in FIG. 2, a pair of air/fuel mixture scavenging passages 13 for directly communicating between the combustion chamber 1*a* and a crankcase chamber 2*a* within the crankcase 2 are formed in part in the cylinder block 1 and in part in the crankcase 2 so as to extend generally vertically. Similarly, a pair of air scavenging passages 14 for communicating between the combustion chamber 1*a* and the crankcase chamber 2*a* through the crankshaft bearings 81 are formed in part in the cylinder block 1 and in part in the crankcase 2 so as to extend generally vertically and on one lateral side of the air/fuel mixture scavenging passage 13 adjacent the exhaust port 12*a*.

Figure 3:
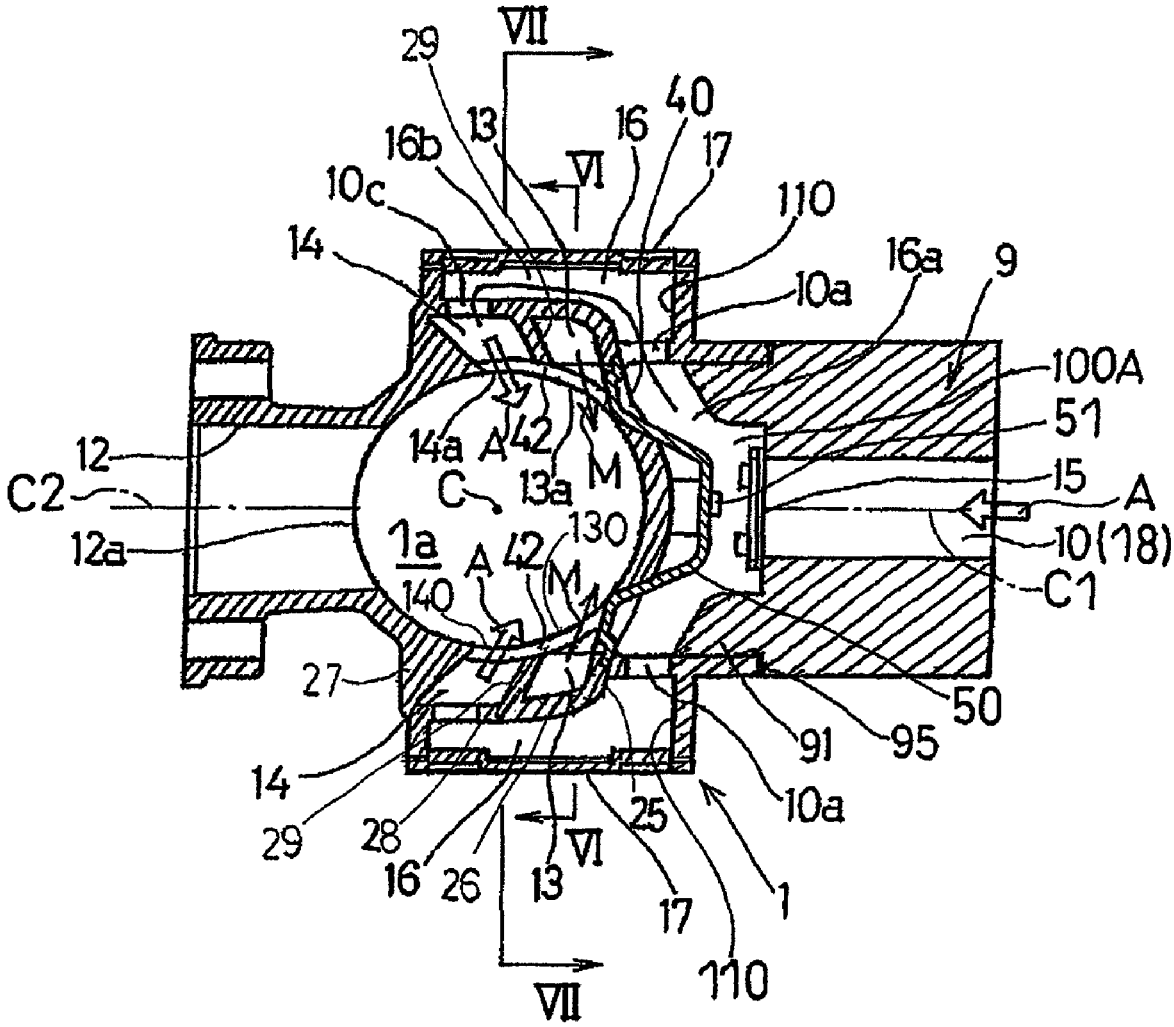
FIG. 3 is a cross-sectional view taken along the line III-III in FIG. 2.

As best shown in FIG. 3, which illustrates a cross sectional view taken along the line III-III in FIG. 2, respective longitudinal axes C1 and C2 of the air supply passage 10 and the exhaust passage 12, when viewed in a direction conforming to the longitudinal axis C of the cylinder bore 1*b*, lie generally in alignment with each other. The pair of the mixture scavenging passage 13 are positioned in symmetrical relation to each other with respect to the longitudinal axis of the intake passage 18, that is, the longitudinal axis C1 of the air supply passage 10 or C2 of the exhaust passage 12. Similarly, the pair of the air scavenging passages 14 are positioned in symmetrical relation to each other with respect to the longitudinal axis of the intake passage 18, that is, the longitudinal axis C1 of the air supply passage 10 or C2 of the exhaust passage 12. The mixture scavenging passages 13 and the air scavenging passages 14 are separated from each other by respective partition walls 29.

Each of the mixture scavenging passages 13 has a sectional shape such as shown in FIG. 3, in which it is delimited by a side wall 25 adjacent the air supply passage 10, a rear wall 26, the partition wall 29 and a mixture scavenging passage wall 130 as will be described later, which is a front wall opposed to the rear wall 26. Similarly, each of the air scavenging passages 14 has a sectional shape in which it is delimited by a side wall 27 adjacent the exhaust passage 12, a rear wall 28, the partition wall 29 and an air scavenging passage wall 140 as will be described later, which is a front wall opposed to the rear wall 28. As best shown in FIG. 2, the mixture scavenging passages 13 have respective mixture scavenging ports 13*a* and the air scavenging passages 14 have respective air scavenging ports 14*a*. An upper edge section of each of the air scavenging ports 14*a*, each defined in an upper end of the corresponding air scavenging passage 14 is so positioned at a level higher than an upper edge section of each of the mixture scavenging ports 13*a*, each defined at an upper end of the corresponding mixture scavenging passage 13, but lower than an upper edge section of the exhaust port 12*a*. Then, during the scavenging stroke of the two-cycle combustion engine, the air can be introduced into the combustion chamber 1*a* earlier than the air/fuel mixture M to perform a scavenging operation.

The air A flowing through the air supply passage 10 defined in the insulator 9 is temporarily introduced into the air scavenging passages 14 through a pair of air introducing passages 16, as will be described later with reference to FIG. 3, by the effect of a negative pressure, which is developed within the crankcase chamber 2*a* during the intake stroke in which the piston 7 ascends within the cylinder bore 1*b*. On the other hand, the air/fuel mixture M flowing through the mixture supply passage 11 defined in the insulator 9 is introduced directly into the crankcase chamber 2*a* through a mixture port 11*a*, defined in the inner peripheral surface of the cylinder block 1, by the effect of the negative pressure when during the intake stroke the piston 7 ascends within the cylinder bore 1*b*.

Figure 4:
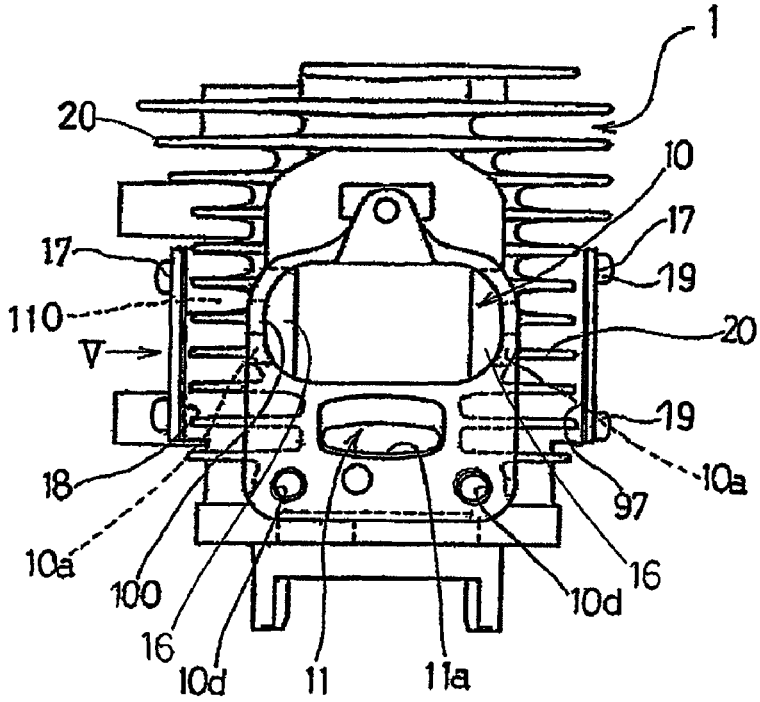
FIG. 4 is a side view showing a cylinder block employed in the two-cycle combustion engine.

Referring now to FIG. 3, the air introducing passages 16 are defined within the cylinder block 1 so as to extend in a direction generally perpendicular to the longitudinal axis C of the cylinder bore 1*b* so that the air A flowing in the air supply passage 10 can be introduced into the air scavenging passages 14. The insulator 9 is formed integrally with protrusions 91 protruding into the cylinder block 1 as will be described later, to form respective wall surfaces of the air introducing passages 16. As best shown in FIG. 4, a first recess 100 is formed in the cylinder block 1 so as to define an upstream portion 16*a* of each of the air introducing passages 16 at a location opposed to the exhaust port 12*a* shown in FIG. 3. This recess 100 is formed simultaneously with the die casting of the cylinder block 1 so as to open in a direction opposed to the exhaust port 12*a* shown in FIG. 3, that is, in a direction parallel to the air supply passage 10. The protrusions 91 described above protrude into the recess 100 to define the upstream portion 16*a* of each of the air introducing passages 16. In addition to the insulator 9, side covers 17 forming side walls of the cylinder block 1 are secured to opposite side portions of the cylinder block 1 so as to define downstream portions 16*b* of the air introducing passages 16.

As shown in FIG. 3, the air supply passage 10 has a downstream port defined in a portion of the insulator 9 in communication with the air introducing passages 16, and a reed valve 15 is fitted to the insulator 9 so as to selectively open or close the downstream port of the air supply passage 10. Specifically, this reed valve 15 is operable to close the downstream port of the air supply passage 10 when a negative pressure developed within the air introducing passages 16 increases to a value equal to or higher than a predetermined value to thereby interrupt the supply of air from the air supply passage 10 into the air introducing passages 16.

Referring still to FIG. 3, in addition to the first recess 100 referred to above and communicated with the air supply passage 10 through the reed valve 15, the cylinder block 1 is also formed with second recesses 110 defined radially outwardly of the cylinder bore 1*b* and laterally outwardly of the mixture and air scavenging passages 13 and 14, which recesses 110 are closed by the respective side covers 17 to define the downstream portions 16*b* of the air introducing passages 16 as hereinabove described. Those downstream portions 16*b* of the air introducing passages 16 are continued from the upstream portion 16*a* of the introducing passage 16 and extend radially outwardly of the cylinder bore 1*b* past the mixture scavenging passage 13 and terminate in communication with the air scavenging passages 14.

The side covers 17 referred to above are fixedly connected to the respective opposite side portions of the cylinder block 1 by means of set screws 19 with a gasket 97 intervening between each of the side covers 17 and the corresponding side portion of the cylinder block 1 as shown in FIG. 4.

The cylinder block 1 so far described above is so designed that the air A flowing through the air supply passage 10 can be introduced from the respective air inlet ports 10*c* into the air scavenging passages 14 after flowing through the air introducing passages 16 when the reed valve 15 is opened. The upstream portions 16*a* and downstream portions 16*b* of the air introducing passages 16 are communicated with each other through respective communicating ports 10*a* defined in the cylinder block 1.

The side wall 25 of each of the mixture scavenging passages 13 intervenes between the respective mixture scavenging passage 13 and the upstream portion 16*a* of the introducing passage 16 and has a throughhole 40 defined therein, which throughhole 40 is in turn closed by a lid 50 as will be described later. Also, a wall between each of the mixture scavenging ports 13*a* and the adjacent air scavenging ports 14*a* is formed with a cutout 42.

Figure 5:
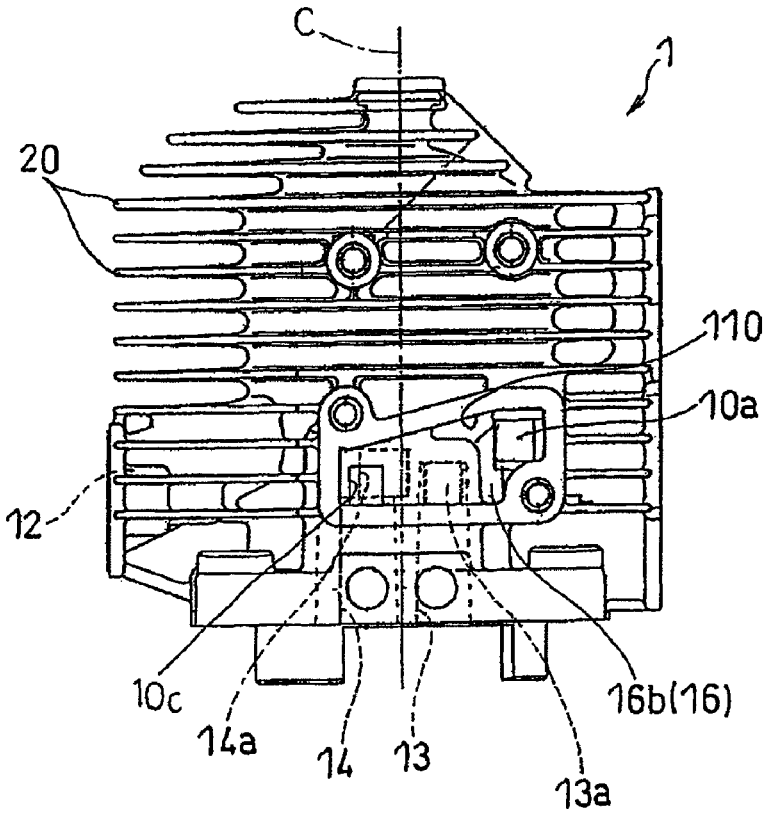
FIG. 5 is a side view of the cylinder block as viewed in a direction indicated by the arrow-headed line V in FIG. 4.

FIG. 5 illustrates a side view of the cylinder block as viewed in a direction indicated by the arrow-headed line V in FIG. 4, with one of the side covers 17 removed to show the details inside the corresponding second recess 110. As shown in FIG. 5, the second recesses 110 have air inlet ports 10*c* defined therein together with the communicating ports 10*a* communicated with the respective air scavenging passages 14. The downstream portions 16*b* of the air introducing passages 16 extend between the communicating ports 10*a* and the air inlet ports 10*c*, respectively. Accordingly, the air A can be introduced from the communicating ports 10*a* into the air scavenging passages 14 through the downstream portions 16*b* of the air introducing passages 16 by way of the air inlet ports 10*c*, respectively.

Figure 6:
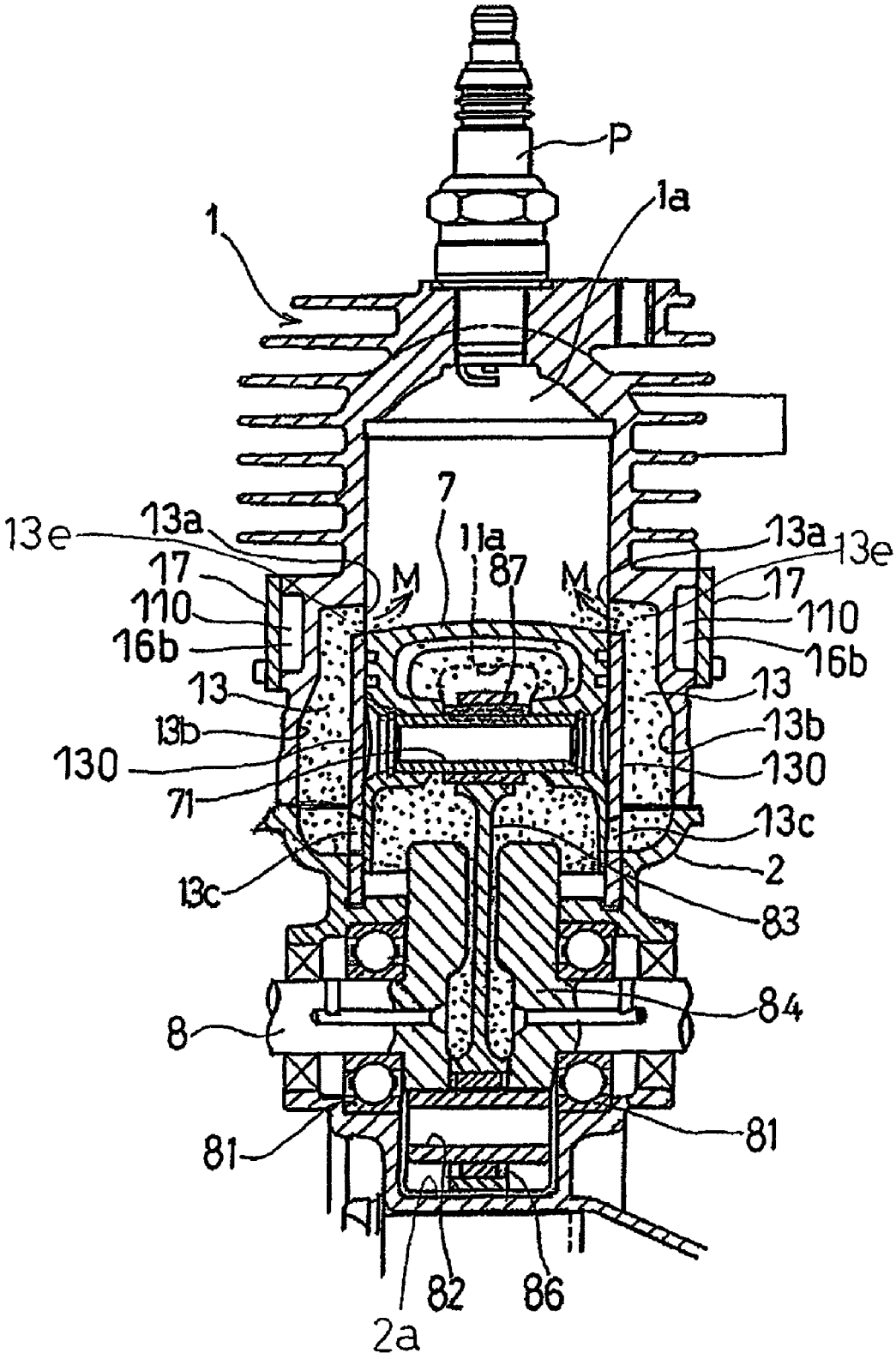
FIG. 6 is a cross-sectional view taken along the line VI-VI in FIG. 3, showing scavenging passages through which a mixed fuel is supplied.

Referring to FIG. 6, each of the mixture scavenging passages 13 shown therein includes a mixture scavenging port 13*a* open at the inner peripheral surface of the cylinder block 1 in communication with the cylinder bore 1*b*, a communicating passageway 13*b* extending vertically downwardly from the mixture scavenging port 13*a* to an upper region of the crankcase 2 past a lower end of the cylinder block 1, and a inflow port 13*c* open at an inner peripheral surface of that upper region of the crankcase 2. A side portion of the communicating passageway 13*b* of each mixture scavenging passage 13 adjacent the cylinder bore 1*b* is covered by the mixture scavenging passage wall 130, and the mixture scavenging port 13*a* and the inflow port 13*c* are defined at locations above and below the mixture scavenging passage wall 130, respectively. Thus, the air/fuel mixture M introduced from the mixture supply passage 11 (shown in FIG. 2) into the crankcase chamber 2*a* is blown diagonally upwardly from the mixture scavenging ports 13*a* into the combustion chamber 1*a* during the scavenging stroke with the piston 7 then descending.

Figure 7:
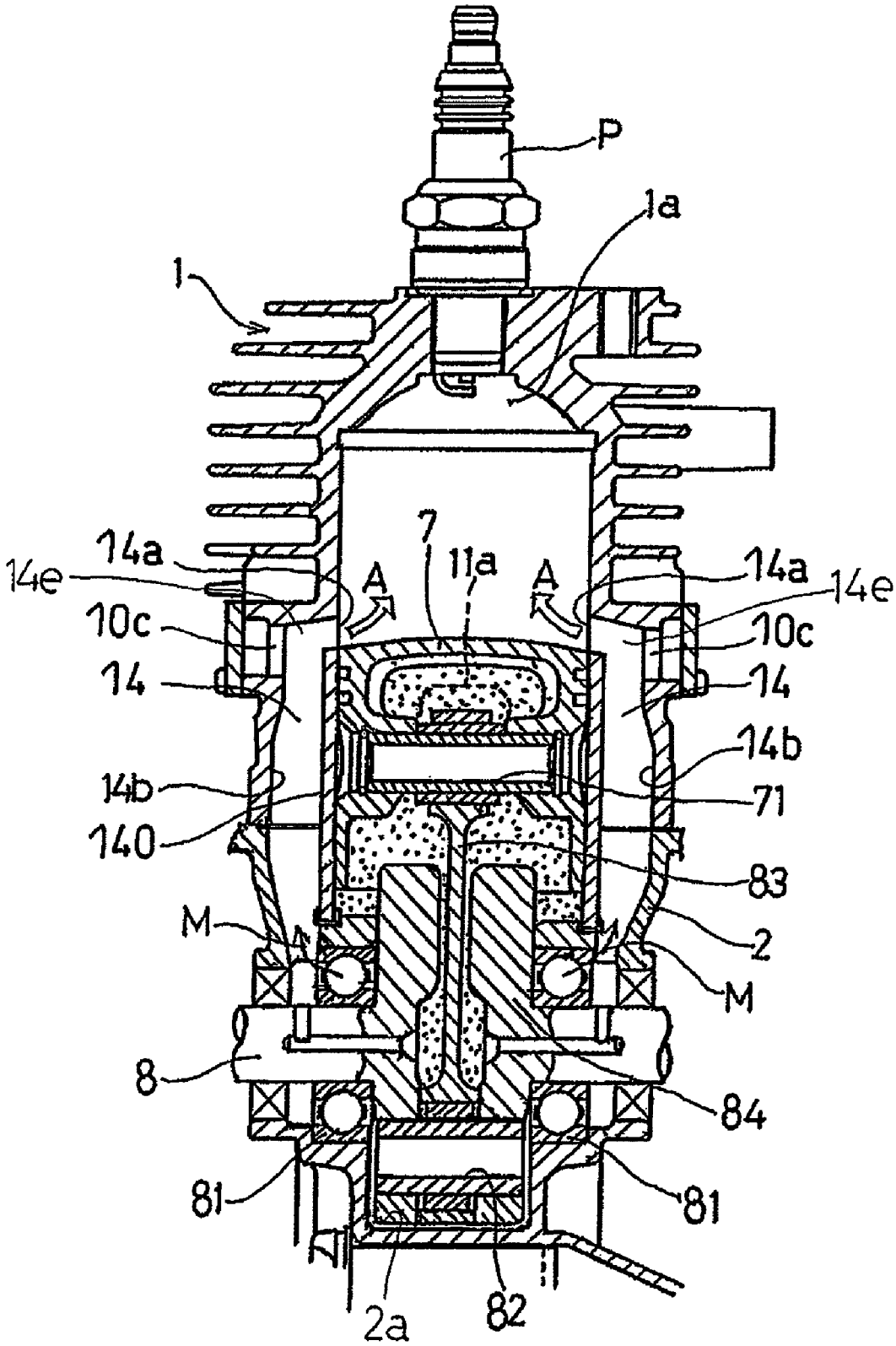
FIG. 7 is a cross-sectional view taken along the line VII-VII in FIG. 3, showing scavenging passages through which an air is supplied.

As best shown in FIG. 7, each of the air scavenging passages 14 includes an air scavenging port 14*a* open at the inner peripheral surface of the cylinder block 1 in communication with the cylinder bore 1*b*, and a communicating passageway 14*b* extending vertically from the air scavenging port 14*a* past the lower end of the cylinder block 1 down to an outer side face of the adjacent crankshaft bearing 81 that is located at a position generally intermediate of the height of the crankcase 2. A side portion of the communicating passageway 14*b* of each air scavenging passage 14 adjacent the cylinder bore 1*b* is covered by the air scavenging passage wall 140, and an air scavenging port 14*a* is defined at locations above the air scavenging passage wall 140. The respective communicating passageway 14*b* has a lower end communicated with the crankcase chamber 2*a* through a gap between inner and outer races of the associated crankshaft bearing 81 and then through a gap between the adjacent crank web 84 and the associated bearing 81.

Thus, the air A introduced from the air supply passage 10 (shown in FIG. 3) into the air scavenging passages 14 through the air introducing passages 16 is blown diagonally upwardly from the air scavenging ports 14*a* into the combustion chamber 1*a* during the scavenging stroke with the piston 7 then descending. Accordingly, the air A so introduced into the combustion chamber 1*a* blocks the air/fuel mixture M to thereby suppress a blow-by of the air/fuel mixture from the exhaust passage 12 to the outside effectively.

As FIG. 4 makes it clear, a downstream portion of the mixture supply passage 11 is formed in a lower region of each of the first recess 100 opening towards the outside of the cylinder block 1, an exit of which forms a mixture supply port 11*a* opening at the inner peripheral surface of the cylinder block 1. Respective peripheral edges of the air supply passage 10 and the mixture supply passage 11 form a flat surface and, as best shown in FIG. 3, a portion of the insulator 9 is held under pressure in contact therewith through a gasket 95. Specifically, the insulator 9 is fixed to the cylinder block 1 with screw members threaded into corresponding screw holes 10*d* (FIG. 4) in the cylinder block after having been passed through respective mounting holes (not shown) defined in the insulator 9 shown in FIG. 3.

The operation of the two-cycle combustion engine of the structure described above will now be described. When the piston 7 within the cylinder bore 1*b* in the cylinder block 1 during the intake stroke arrives at the top dead center as shown in FIG. 2 and the cylinder bore 1*b* and the crankcase chamber 2*a* are held in a negative pressure, the air/fuel mixture M is introduced directly into the crankcase chamber 2*a* through the mixture port 11*a* open at the inner peripheral surface of the cylinder block 1. The air/fuel mixture M so introduced is utilized to lubricate the large diameter end bearing, i.e., the crankpin journal 86 and the small diameter end bearing or piston journal 87. At this time, since the air scavenging passages 14 communicated with the crankcase chamber 2*a* through the crankshaft bearings 81 are also held in a negative pressure, the air introducing passages 16 communicated respectively with those air scavenging passages 14 is hence held in a negative pressure and, accordingly, the reed valve 15 disposed at the outlet of the air supply passage 10 in the insulator 9 is opened to allow the air A from the air supply passage 10 to be temporarily introduced into the air scavenging passages 14 through the air introducing passages 16. In this way, when the reed valve 15 is opened by the effect of the negative pressure within the crankcase chamber 2*a* shown in FIG. 2 during the intake stroke, the air A flowing through the air supply passage 10 is introduced at all times into the air scavenging passages 14. For this reason, a sufficient amount of air necessary to avoid the blow-by can be secured within the air scavenging passages 14.

During the subsequent scavenging stroke, the air/fuel mixture M from the mixture scavenging ports 13*a* of the mixture scavenging passages 13 and the air A from the air scavenging ports 14*a* of the air scavenging passages 14 are introduced into the combustion chamber 1*a*. At this time, since the air A is first introduced from the air scavenging ports 14*a* into the combustion chamber 1*a* and the air/fuel mixture M is then introduced from the mixture scavenging ports 13*a* into the combustion chamber 1*a* at a timing slightly delayed relative to the introduction of the air A from the air scavenging ports 14*a* and since the air A is so introduced into the combustion chamber 1*a* at a locations closer to the exhaust port 12 than the air/fuel mixture M, that is, the air scavenging ports 14*a* are located on one side of the mixture scavenging ports 13*a* adjacent the exhaust port 12, combustion gases can be discharged from the exhaust port 12*a* by the action of the air A introduced earlier than the air/fuel mixture M and, therefore, the blow-by of the air/fuel mixture M from the exhaust port 12*a* can be avoided.

When the air A from the air scavenging passages 14 shown in FIG. 7 is introduced into the combustion chamber 1*a* in the manner described above, a portion of the air/fuel mixture M within the crankcase chamber 2*a* flows into the air scavenging passages 14 through the gap between the crankshaft bearings 81 and, therefore, the crankshaft bearings 81 are lubricated by a fuel component contained in such air/fuel mixture M.

Since as hereinbefore described, the air introducing passages 16 through which the air flowing in the air supply passage 10 can be introduced into the air scavenging passages 14 are so formed in the cylinder block 1 as to extend laterally outwardly of the mixture scavenging passages 13 in the cylinder block 1, the use of component parts such as connecting pipes and clamps can be dispensed with and, therefore, the number of component parts used and the number of assembling steps required can be reduced advantageously. Also, since the air introducing passages 16 is defined by the first recess 100 and the protrusions 91 of the insulator 9 protruding thereinto by mean of a casting technique, the recess 100 in the cylinder block 1 can be formed having a simplified shape, resulting in minimization of the cost of manufacture of the cylinder block 1.

The first, large recess 100 formed in the cylinder block 1 by means of a casting technique to form the air introducing passages 16 therein are infilled with the protrusions 91 formed integrally with the insulator 9 and are therefore narrowed and the capacity of the crankcase chamber 2*a* communicated with the first recess 100 is therefore substantially reduced. Accordingly, the air A can have a sufficient blow pressure during the scavenging stroke.

Hereinafter, the cylinder block of the two-cycle combustion engine so constructed as hereinabove and a method for manufacturing such cylinder block will be described with particular reference to FIGS. 8 to 16. The cylinder block of the present invention for the two-cycle combustion engine is essentially featured in that neither a disposable core nor a slider core is employed during the molding of the cylinder block.

Figure 8:
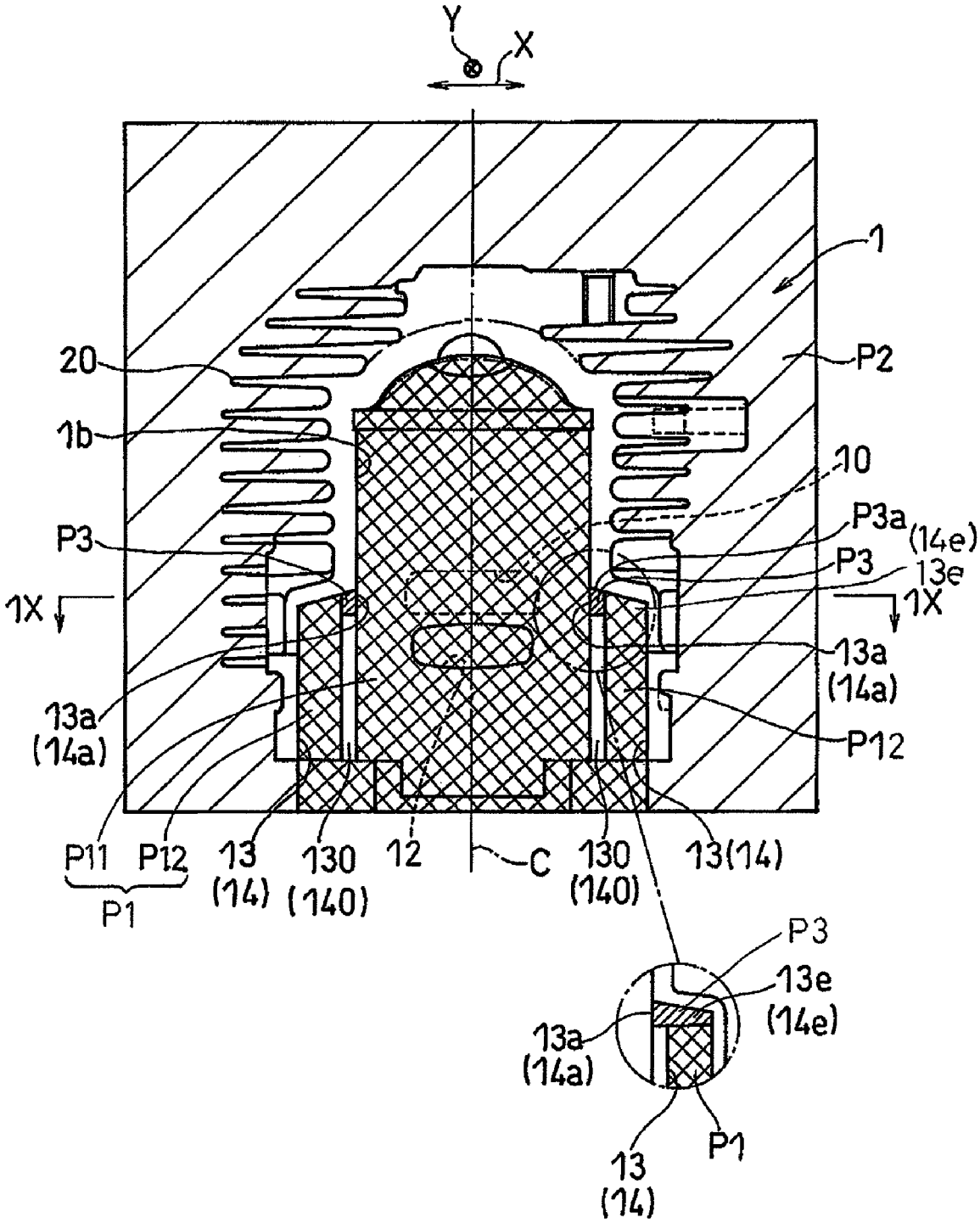
FIG. 8 is a schematic longitudinal sectional view of a mold assembly used to manufacture the cylinder block.

Referring now to FIG. 8, there is shown a cross-sectional view taken along the line VIII-VIII in FIG. 5, showing a mold assembly used to cast the cylinder block. As shown therein, during the die casting of the cylinder block 1, the cylinder bore 1*b* and the two pairs of the scavenging passages 13 and 14 are formed by drawing an inner mold P1 downwardly along the longitudinal axis C of the cylinder block 1. The mold P1, which forms the inner mold, is of a shape including a bore forming portion P11 complemental in shape to and eventually forming the cylinder bore 1*b*, and scavenging passage forming portions P12 eventually forming the scavenging passages 13 and 14 except for the scavenging ports 13*a* and 14*a*. Each of the forming portions P11 and P12 is so shaped as to taper upwardly to allow it to have a draft angle. The bore forming portion P11 and the scavenging passage forming portions P12 are not communicated with each other in a direction radially of the cylinder bore 1*b* and scavenging passage walls 130 and 140 are formed within a space therebetween.

The cylinder block 1 has its contour molded by a separated outer mold P2 that can be moved in a forward and rearward direction X and also in a left and right direction Y One of divided molds forming the outer mold P2 includes molding pieces P3 for forming the mixture scavenging ports 13*a* and the air scavenging ports 14*a* that are included in upper portions 13*e* of the mixture scavenging passages 13 and upper portions 14*e* of the air scavenging passages 14, respectively. Upper end face P3*a* of those molding pieces P3 are somewhat diagonally upwardly inclined towards the cylinder longitudinal axis C in correspondence with upper faces of the mixture scavenging ports 13*a* and those of the air scavenging ports 14*a*.

Figure 9:
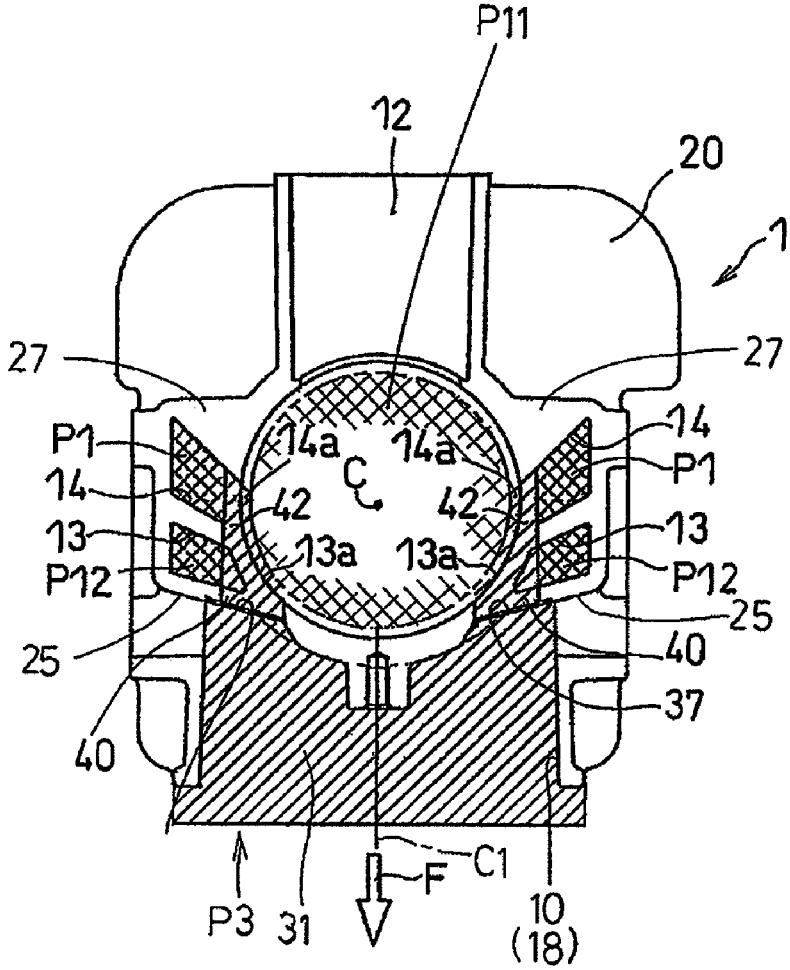
FIG. 9 is a cross-sectional view taken along the line IX-IX in FIG. 8.
Figure 10:
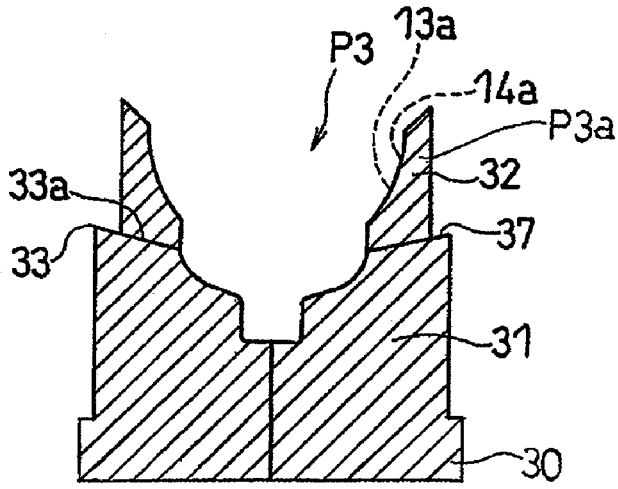
FIG. 10 is a schematic horizontal sectional view of a molding piece used to form a fuel intake passage and an upper portion of the scavenging passage.
Figure 11:
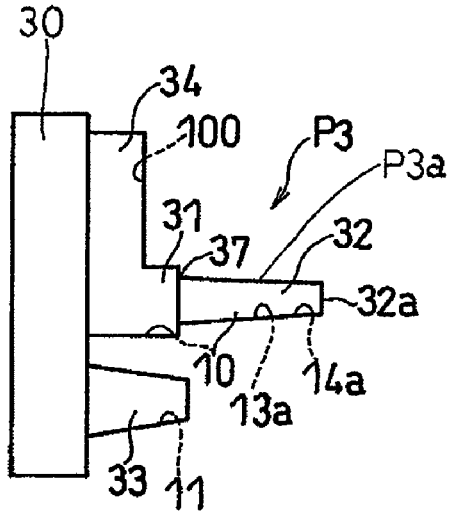
FIG. 11 is a schematic side view of the molding piece.
Figure 12:
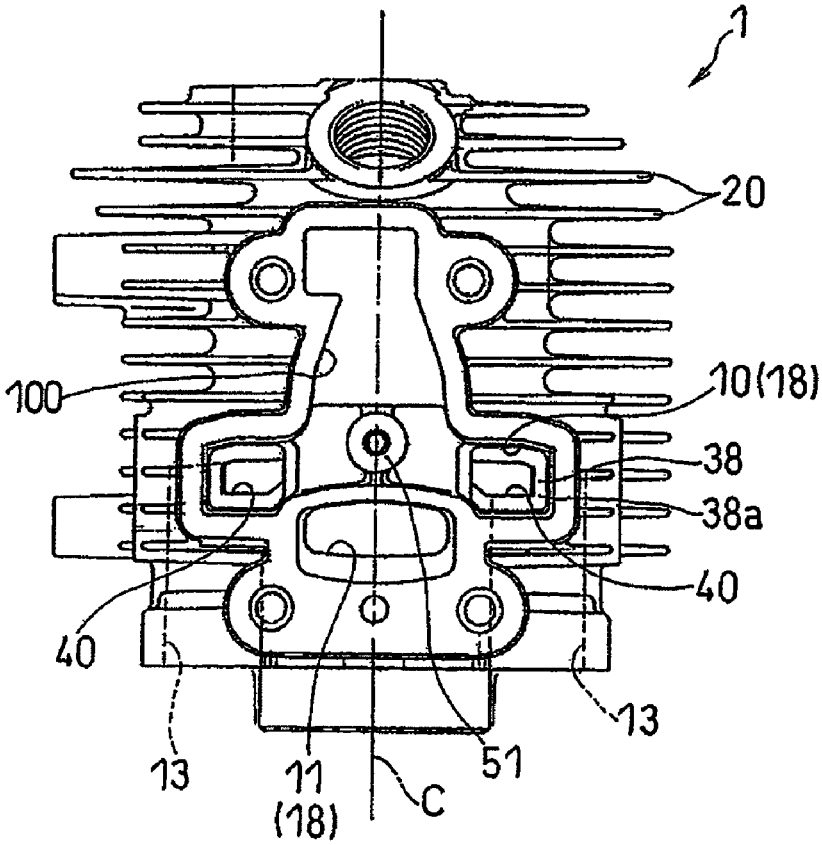
FIG. 12 is a side view of the cylinder block after the molding piece has been removed, as viewed from a side of the fuel intake passage.

FIG. 9 illustrates a schematic cross-sectional view taken along the line IX-IX in FIG. 8. As FIG. 9 makes it clear, the molding piece P3 is used to form the intake passage 18 including the air supply passage 10 and the mixture supply passage 11, the mixture scavenging ports 13*a* and the air scavenging ports 14*a*. As best shown in FIG. 10, this molding piece P3 includes a base 30, an air supply passage forming portion 31 provided at the base 30 for defining the air supply passage 10 and scavenging passage forming portions 32, protruding from the air supply passage forming portion 31, for defining the mixture and air scavenging ports 13*a* and 14*a*. Also, as best shown in FIG. 11, the base 30 of the molding piece P3 is provided with a mixture supply passage forming portion 33 for defining the mixture supply passage 11 and projection forming portions 34 for defining the first recesses 100 (FIG. 12).

The air supply passage forming portion 31 is thick and the scavenging passage forming portions are thinner than the air supply passage forming portion 31, and shoulders 37 are provided between the air supply passage forming portion 31 and the scavenging passage forming portions 32. Each of the scavenging passage forming portions 32 is of a shape outwardly tapered towards its tip 32*a* to form associated throughhole 40 and the cutout 42 between the mixture and air scavenging passages 13 and 14 shown in FIG. 9.

Figure 13:
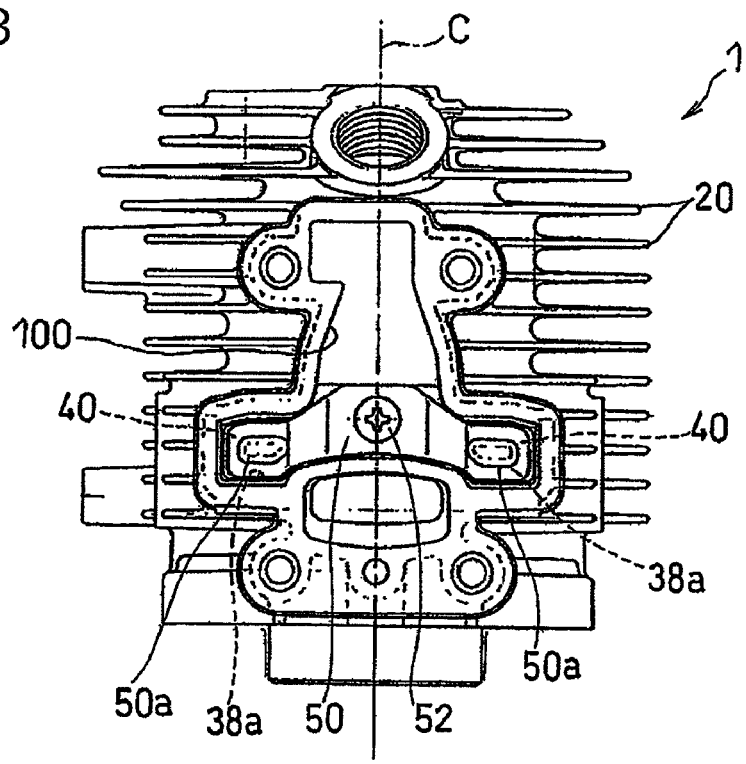
FIG. 13 is a side view of the cylinder block after a throughhole has been closed by a lid, as viewed from the side of the fuel intake passage.
Figure 14:
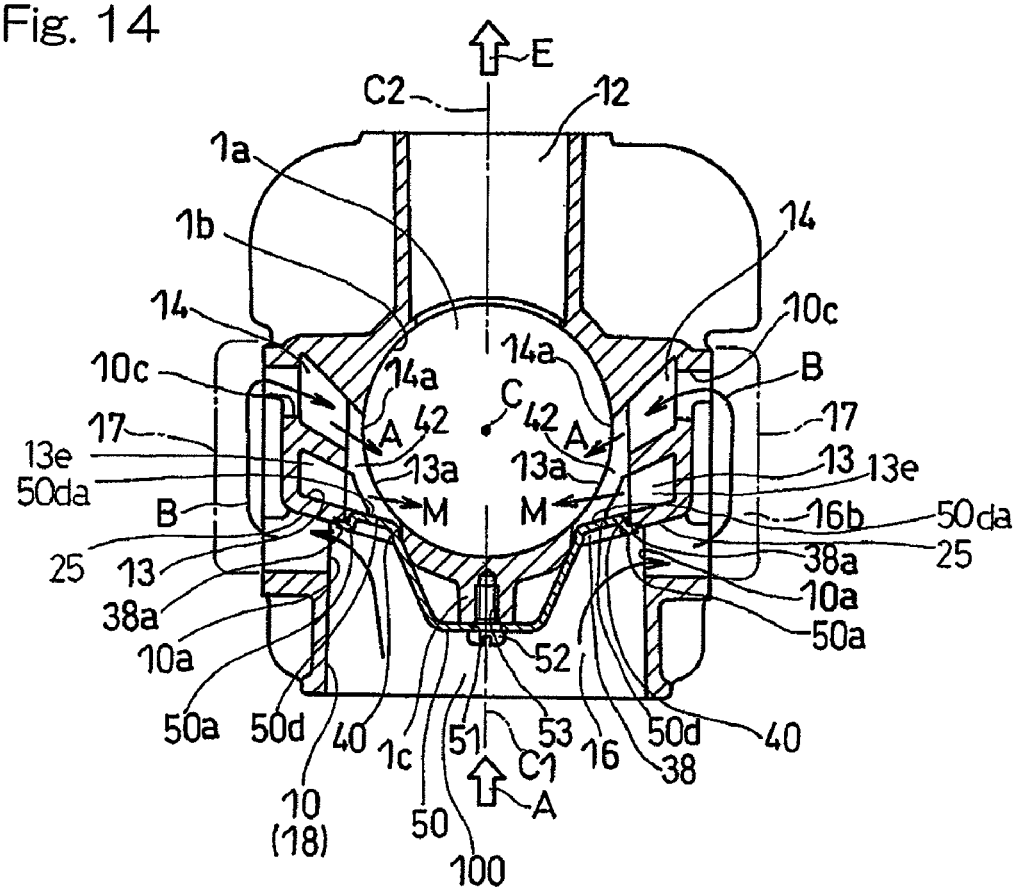
FIG. 14 is a transverse sectional view showing an important portion of the cylinder block after the throughhole has been closed by the lid.

After the molding of the cylinder block 1, the molding piece P3 is removed in a direction F radially outwardly as viewed in FIG. 9, that is, outwardly along the longitudinal axis C1 of the intake passage 18 in the cylinder block 1 to open the mold assembly, leaving the scavenging ports 13*a* and 14*a* together with the intake passage 18. Since the molding piece P3 is removed after having been moved in a direction towards the intake passage 18, cooling fins 20 adjacent the exhaust passage 12 which is of a high temperature in use, can be retained as they stand in shape and number. At this stage, as shown in FIG. 12 as viewed from the side of the intake passage 18, steps 38 complemental in shape to the shoulders 37 in the molding piece P3 exist at portions of respective peripheral edges of the throughholes 40 between upper portions of the mixture scavenging passages 13 and the air supply passage 10, with stepped faces 38*a* of those steps 38 exposed towards the air supply passage 10. The throughholes 40 are closed by the lid 50 as shown in FIG. 13. In other words, the throughholes 40 are closed by bringing opposite end portions 50*a* of the lid 50 into engagement with the stepped faces 38*a*. Then a fastening member such as a screw 52 is inserted through a mounting hole 51 defined in the lid 50 as shown in FIG. 14, and fitted into a threaded hole 53 defined in a mounting seat portion 1*c* of the cylinder block 1 with the opposite ends 50*a* of the lid 50 consequently secured to the cylinder block 1. When the throughholes 40 are so closed by the lid 50 in this way, the mixture scavenging passages 13 and the air supply passage 10 are shielded from each other.

Since those upper portions of the mixture scavenging passages 13 and those upper portions of the air scavenging passages 14 are communicated with each other through the cutout 42, respectively, a portion of the air/fuel mixture M within the mixture scavenging passages 13 enters the adjacent air scavenging passages 14. However, the amount of that portion of the air/fuel mixture M entering the air scavenging passages 14 is so small that influences brought about thereby can be negligible. The air A from the air supply passage 10, which is a part of the fuel intake passage 18, flows from the communicating holes 10*a* and then flows in respective directions shown by the arrows B and is finally introduced into the air scavenging passages 14 through the downstream portions 16*b* of the introducing passage 16, defined between the cylinder block 1 and the side covers 17 and then through the air inlet ports 10*c*.

It is to be noted that since each of the throughholes 40 is of a simplified structure which extends from a respective upper portion of the scavenging passages 13 and 14 towards the fuel intake passage 18 and can easily be closed by the lid 50 after the manufacture of the cylinder block 1, the molding pieces P3 used can have a simplified shape as shown in FIGS. 10 and 11.

Figure 15:
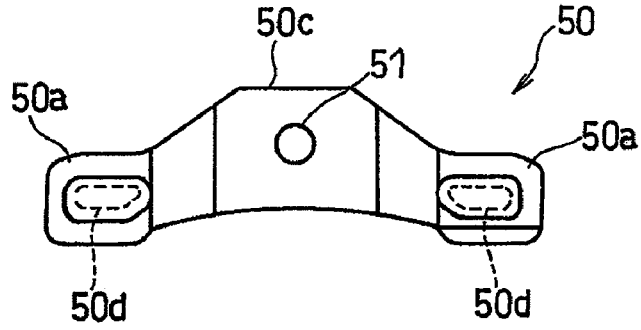
FIG. 15 is a front elevational view of the lid.
Figure 16:
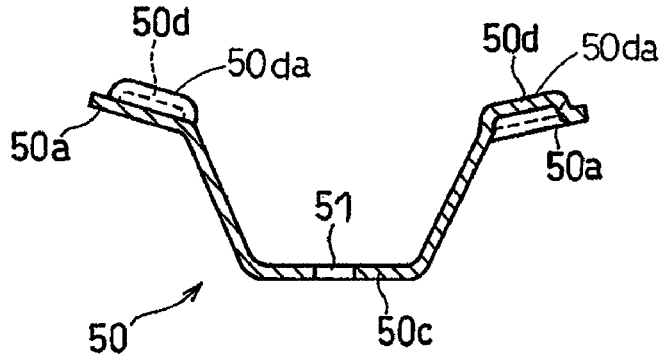
FIG. 16 is a cross-sectional view of the lid.

FIG. 15 illustrates a front elevational view of the lid 50 and, as shown therein, this lid 50 is prepared from a plate member by the use of any known press work. This lid 50 has the mounting hole 51 defined at an intermediate portion thereof and also has its opposite ends 50*a* formed with respective guide projections 50*d* and 50*d* shown in FIG. 16.

The lid 50 may be prepared from a block material by the use of any known cutting technique. A material used to form the lid 50 may be aluminum or an aluminum alloy, which is the same as that for the cylinder block 1, or any other material having a small difference in coefficient of thermal expansion from the cylinder block 1.

Each of the guide projections 50*d* at the opposite ends 50*a* of the lid 50 is, as best shown in FIG. 14, positioned in a respective upper portion 13*e* of the corresponding mixture scavenging passage 13, having its end face 50*da* held generally in flush with inner surfaces of the mixture scavenging passage 13. Accordingly, since the air/fuel mixture M emerging outwardly from the mixture scavenging ports 13*a* is smoothly guided by the guide projections 50*d* and 50*d* to flow into the combustion chamber 1*a*, the flow of the mixture M thereinto can be made smooth to increase the scavenging efficiency. Also, since the guide projections 50*d* and 50*d* are formed integrally with the lid 50 by pressing the plate member with the use of any known press work as hereinbefore described, an increase of the number of component parts used can be suppressed. Yet, the lid 50, when held in engagement with the stepped faces 38*a*, can be supported stably. In addition, since the stepped faces 38*a* serve as sealing surfaces, the lid 50 contributes to an increase of sealability after the throughholes 40 have been closed thereby.

Figure 17:
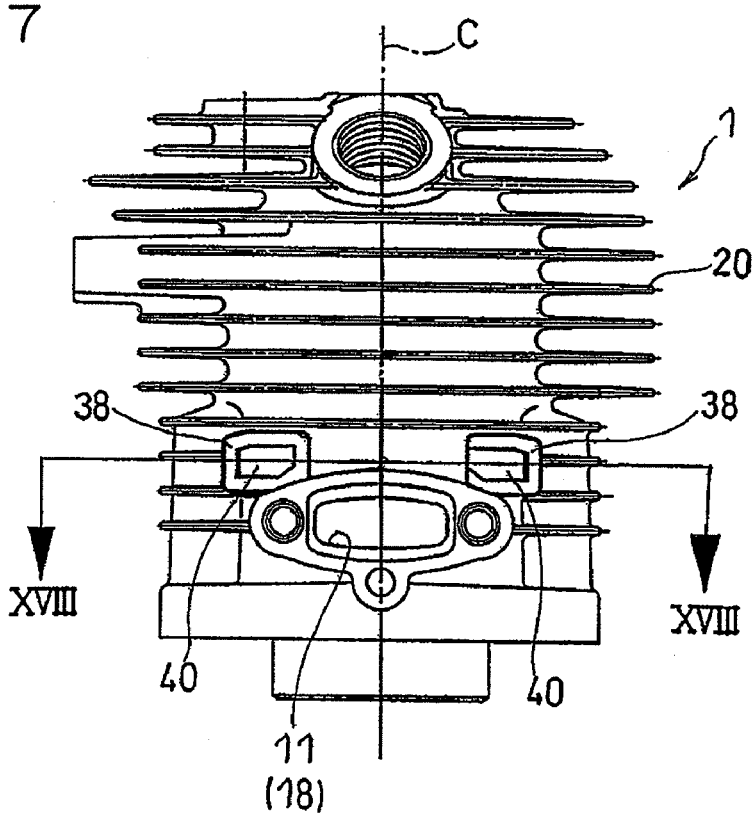
FIG. 17 is a side view corresponding to that of FIG. 12, showing a second embodiment of the present invention.
Figure 18:
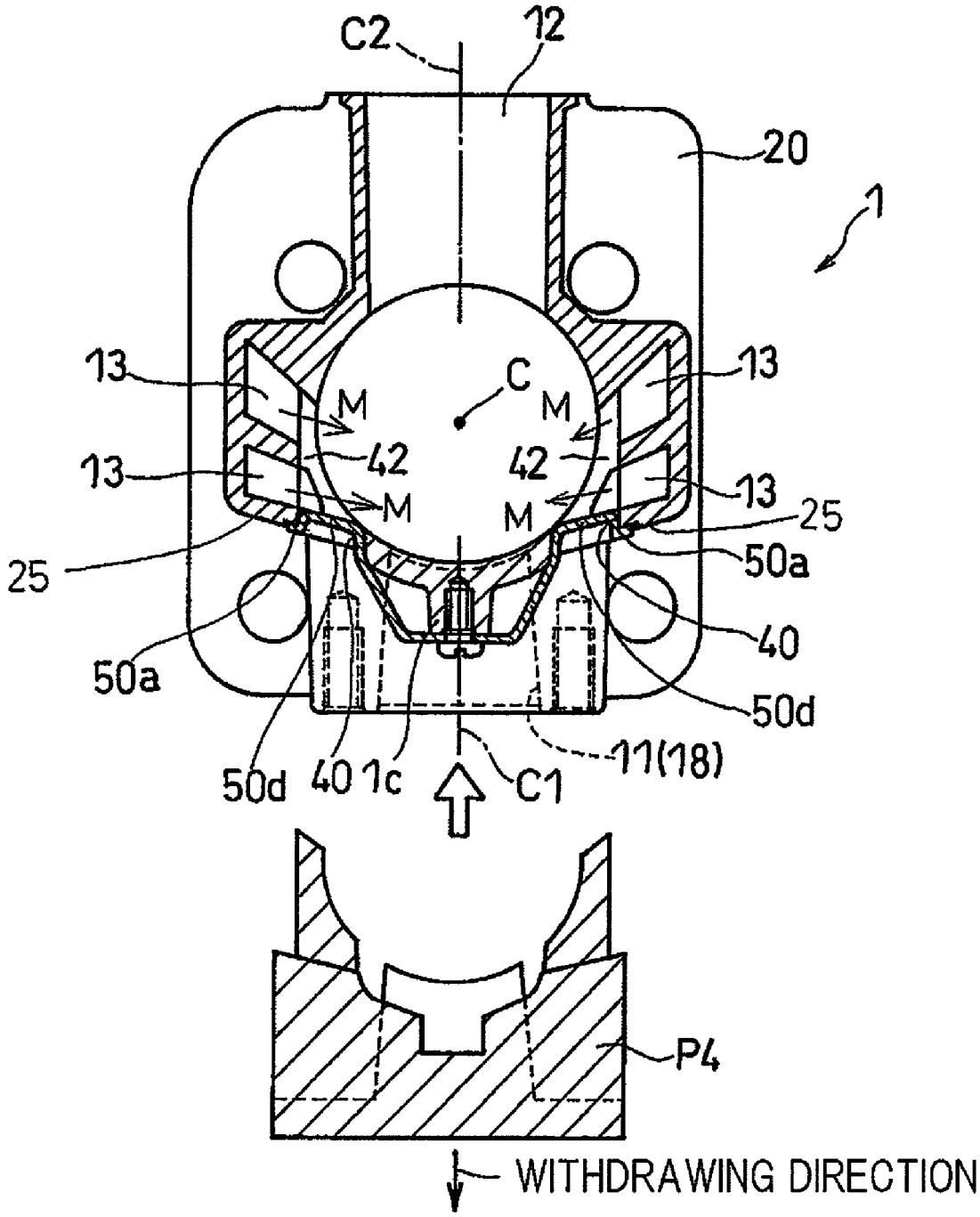
FIG. 18 is a cross-sectional view taken along the line XVIII-XVIII in FIG. 17.

A second preferred embodiment of the present invention will be hereinafter described with particular reference to FIG. 17 corresponding to FIG. 12. The cylinder block 1 shown therein is of a construction, in which the intake passage 18 has only the mixture supply passage 11 and has no air supply passage. In this case, the throughholes 40 open directly to the outside of the cylinder block 1. As shown in FIG. 18, showing a cross-sectional view taken along the line XVIII-XVIII in FIG. 17, the throughholes 40 are formed by the use of a molding piece P4, which is withdrawn towards a direction conforming to the longitudinal axis C1 of the mixture supply passage 11. The lid 50 has their opposite ends 50*a* closing the throughholes 40. The scavenging passages 13 are provided in two pairs for supplying the air/fuel mixture M into the combustion chamber 1*a*, with those two pairs positioned on each sides of the longitudinal axis C1 of the mixture supply passage 11 or the longitudinal axis C2 of the exhaust passage 12 in symmetrical relation to each other. Even with this arrangement, effects similar to those afforded by the previously described first embodiment of the present invention can be obtained.

Figure 19:
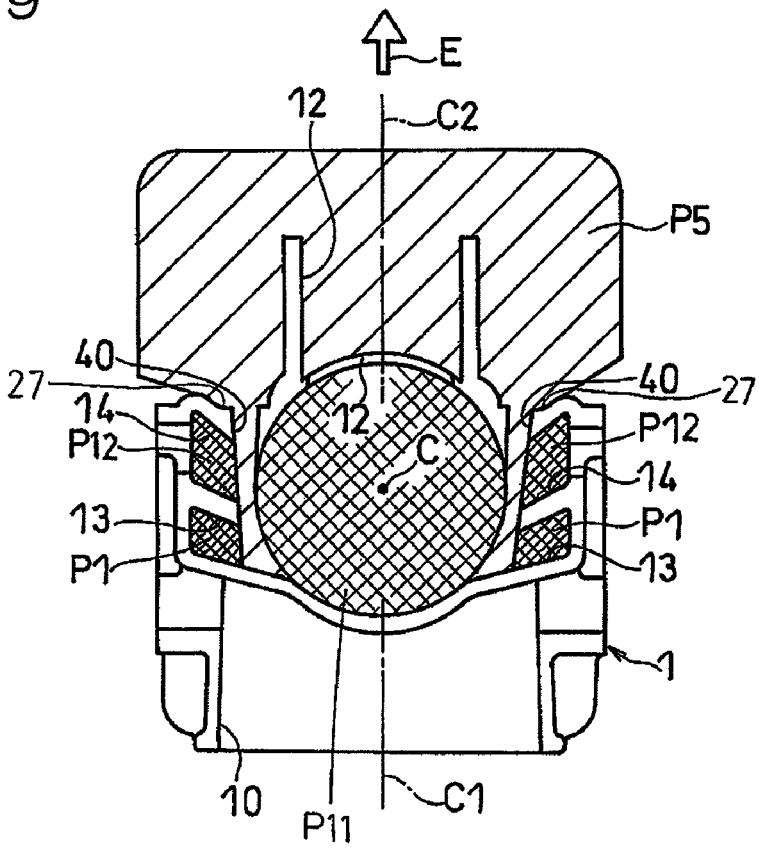
FIG. 19 is a transverse sectional view, corresponding to that of FIG. 9, showing the manner of molding of the cylinder block with the use of the molding piece in accordance with a third embodiment of the present invention.
Figure 20:
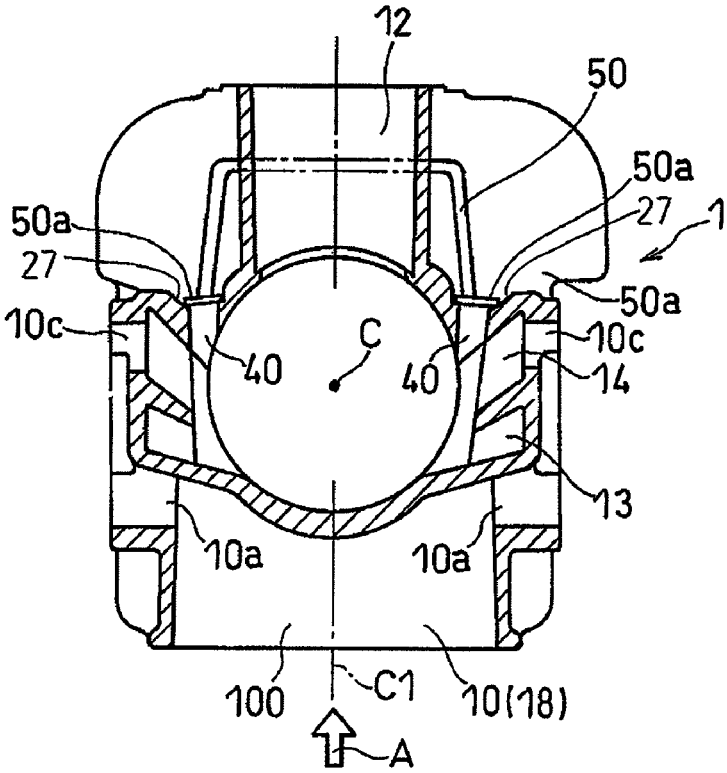
FIG. 20 is a transverse sectional view of the cylinder block after the molding piece has been removed.

A third preferred embodiment of the present invention will now be described with particular reference to FIG. 19. FIG. 19 illustrates a cross-sectional view corresponding to FIG. 9, showing the manner of removing from the side of the exhaust passage 12. The cylinder block 1 shown therein is basically the same as that according to the previously described first embodiment and the two mixture scavenging passages 13 and the two air scavenging passages 14 are employed. Although in the practice of the first embodiment of the present invention as hereinbefore described, the molding piece P3 has been shown and described as removed from the side of the fuel intake passage 18 (from the side of the air supply passage 10), the third embodiment of the present invention shown in FIG. 19 is such that the throughholes 40 are provided in the side walls 27 of the air scavenging passages 14 adjacent the exhaust passage 12 and a molding piece P5 is removed to the outside E through the throughholes 40 and along the longitudinal axis C2 of the exhaust passage 12. After the molding of the cylinder block 1, as shown in FIG. 20, the opposite ends 50*a* of the lid 50 are brought into contact with the throughholes 40 from the outside to thereby close the throughholes 40, respectively.

Although in any one of the foregoing first to third embodiments of the present invention, only the scavenging ports 13*a* and 14*a*, which are a part of the upper portions of the scavenging passages 13 and 14, have been formed with the use of the molding pieces P3 to P5, upper portions 13*e* and 14*e*, in their entirety, of the scavenging passages 13 and 14 including the scavenging ports 13*a* and 14*a*, shown in a single dotted circle of FIG. 8, may be formed with the use of the molding pieces P3 to P5.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. For example, the throughholes 40 can be formed by the use of any other methods such as an electric discharge machining without relying on the use of any molds.

Accordingly, such changes and modifications are, unless they depart from the scope of the present invention as delivered from the claims annexed hereto, to be construed as included therein.

What is claimed is:

1. A cylinder block for a two-cycle combustion engine comprising:

a cylinder bore;

a combustion chamber defined in the cylinder bore;

an intake passage for charging an intake gas;

an exhaust passage for discharging an exhaust gas from the combustion chamber;

a scavenging passage extending between the combustion chamber and a crankcase chamber below the cylinder bore to communicate them together, and having a scavenging port defined in the cylinder bore so as to open at an inner peripheral surface forming the cylinder bore, the scavenging passage being delimited by a first side wall adjacent the intake passage, a rear wall away from the scavenging port and a second side wall adjacent the exhaust passage;

a throughhole defined in the first or second side wall of the scavenging passage on one side adjacent the intake passage or the exhaust passage and communicating an upper portion of the scavenging passage, including the scavenging port, with the intake passage or outside of the cylinder bore; and a lid affixed to an external surface of the scavenging passage such that the throughhole is permanently sealed.

2. The cylinder block for the two-cycle combustion engine as claimed in claim 1, wherein the lid is provided with a guide projection positioned in the upper portion of the scavenging passage for guiding a scavenging gas.

3. The cylinder block for the two-cycle combustion engine as claimed in claim 1, wherein:

the scavenging passage is provided in a pair on respective sides with respect to a longitudinal axis of the intake passage or the exhaust passage;

each of the scavenging passages includes a mixture scavenging passage for supply of an air/fuel mixture and an air scavenging passage for supply of an air, the mixture and air scavenging passages being arranged in a circumferential direction of the cylinder bore;

the intake passage includes a mixture supply passage communicated with the mixture scavenging passage and an air supply passage communicated with the air scavenging passage;

the air scavenging passage is positioned closer to the exhaust passage than the mixture scavenging passage is; and the mixture scavenging passage and the air scavenging passage are communicated with each other through the throughhole.

4. The cylinder block for the two-cycle combustion engine as claimed in claim 3, wherein an upper portion of each of the scavenging passages, which upper portion extends radially of the cylinder bore and communicates with the corresponding scavenging port, has a vertical dimension, which is smaller than that of the air supply passage, and a stepped face of a step between the upper portion of the scavenging passage and the air supply passage is formed in a peripheral edge of the throughhole so as to be exposed to the air supply passage; and wherein the lid is held in engagement with the stepped face.

5. A method for forming the cylinder block for the two-cycle combustion engine as defined in claim 1 by means of a casting, which comprises the steps of:

forming the intake passage or the exhaust passage, an upper portion of the scavenging passage including the scavenging port, the throughhole defined therebetween, by using a molding piece movable in a direction conforming to a longitudinal axis of the intake passage or the exhaust passage; and permanently closing the throughhole with the lid.

6. The method for forming the cylinder block for the two-cycle combustion engine as claimed in claim 5, further comprising providing a guide projection for guiding the scavenging gas in the lid so as to occupy a position in the upper portion of the scavenging passage.

7. The cylinder block for the two-cycle combustion engine as claimed in claim 1, wherein the lid is stationarily fixed to form a portion of the scavenging passage.

8. The cylinder block for the two-cycle combustion engine as claimed in claim 7 wherein the lid is elongated with a pair of guide projections adjacent opposite ends of the elongated lid and an intermediate portion of the lid is stationarily fixed to force the guide projections to permanently seal the throughhole.

9. The method for forming the cylinder block for the two-cycle combustion engine as claimed in claim 5, wherein a pair of scavenging passages are respectively formed for a fuel mixture and air and the throughhole extends between a wall separating the pair of scavenging passages, the lid stationarily seals the throughhole and forms a permanent portion of the pair of scavenging passages.

* * * * *